US005891612A

United States Patent [19]

Nair et al.

[11] Patent Number: 5,891,612

[45] Date of Patent: Apr. 6, 1999

[54] PHOTOGRAPHIC ELEMENTS COMPRISING HIGHLY LOADED PARTICULATE MATERIAL CONTAINING LAYER

[75] Inventors: Mridula Nair, Penfield; Lloyd A. Lobo, Webster; George L. Oltean; Tamara K. Osburn, both of Rochester, all of N.Y.

[73] Assignee: Eastman Kodak Company, Rochester, N.Y.

[21] Appl. No.: 919,923

[22] Filed: Aug. 28, 1997

[51] Int. Cl.[6] ..... G03C 1/795; G03C 1/81; G03C 1/89; G03C 1/93

[52] U.S. Cl. ..... 430/530; 430/523; 430/527; 430/593; 430/930

[58] Field of Search ..... 430/523, 527, 430/530, 539, 930

[56] References Cited

U.S. PATENT DOCUMENTS

| | | | |
|---|---|---|---|
| 5,070,006 | 12/1991 | Krafft et al. | 430/531 |
| 5,147,768 | 9/1992 | Sakakibara | 430/501 |
| 5,334,494 | 8/1994 | Ueda et al. | 430/523 |
| 5,382,494 | 1/1995 | Kudo et al. | 430/527 |
| 5,457,012 | 10/1995 | Nair et al. | 430/523 |
| 5,457,013 | 10/1995 | Christian et al. | 430/496 |
| 5,520,954 | 5/1996 | Oltean et al. | 427/128 |
| 5,531,913 | 7/1996 | Nair et al. | 252/62.53 |
| 5,633,126 | 5/1997 | Dickerson et al. | 431/501 |
| 5,731,119 | 3/1998 | Eichorst et al. | 430/527 |
| 5,753,426 | 5/1998 | Nair et al. | 430/523 |

FOREIGN PATENT DOCUMENTS

| | | |
|---|---|---|
| 71995-77757 | 3/1995 | Japan . |

*Primary Examiner*—Richard L. Schilling
*Attorney, Agent, or Firm*—Andrew J. Anderson

[57] ABSTRACT

A photographic element is disclosed comprising a film support, at least one light-sensitive layer, a highly loaded layer which contains more than 30 volume percent of non-film forming particulate material, and upper and lower aqueous coated adjacent layers which are next to the highly loaded layer, the upper adjacent layer being further from the support and the lower adjacent layer being closer to the support relative to the highly loaded layer, each adjacent layer having a film forming binder content of greater than 70 volume percent, and the lower adjacent layer being at least 1.0 micron thick. In accordance with a preferred embodiment of the invention, an imaging element having excellent adhesion characteristics is obtained in combination with excellent magnetic recording characteristics and photographic transparency where the non-film forming particulate material in the highly loaded layer comprises conductive particles, the layer adjacent to the highly loaded layer which is closer to the support comprises a hydrophilic curl control layer, and the layer adjacent to the highly loaded layer which is further from the support or a layer coated thereover comprises an aqueous coated transparent magnetic recording layer, by virtue of the physical flatness, low granularity, and optical density of the element. Also disclosed is a process for simultaneously applying a plurality of coating compositions comprising an aqueous magnetic recording layer coating composition, an antistatic layer aqueous coating composition, and a curl control layer aqueous coating composition, along with other optional conventional gelatin containing aqueous coated layers, onto a support. The placing of the highly filled antistatic layer between two aqueous coated adjacent layers, which in a preferred embodiment of the invention comprise a magnetic recording layer and a curl control layer or two curl control layers, results in excellent adhesion of the coated layers to the support compared to where the antistatic layer is closest to the support. The mechanical properties of a photographic element containing such a highly filled layer is substantially strengthened when the highly filled layer is sandwiched between the two other aqueous coated layers.

31 Claims, No Drawings

PHOTOGRAPHIC ELEMENTS COMPRISING HIGHLY LOADED PARTICULATE MATERIAL CONTAINING LAYER

FIELD OF THE INVENTION

This invention relates to light sensitive photographic elements and, more particularly, to a light sensitive photographic element comprising a highly loaded particulate material containing layer, such as an antistatic layer, which comprises high loading levels of non-film forming particulate materials, such as conductive metal oxide particles.

BACKGROUND OF THE INVENTION

Photographic elements are desirably provided with one or more conductive antistatic layers to prevent undesirable static discharges during manufacture, exposure and processing of the photographic element. Antistats proposed for use in photographic elements include non-film forming particulate materials comprising metal oxides, for example, tin oxide, antimony doped tin oxide, vanadium pentoxide, and metal antimonate particles. Such particulate materials are generally coated in a thin layer at relatively high loading levels relative to any film forming binder in order to provide good antistatic performance while maintaining photographic transparancy. In order to provide good adhesion to a photographic element support, such highly loaded antistatic layers have generally been coated directly over a thin subbing layer on the support. Such antistatic layers are conventionally typically coated on the opposite side ("back-side") of the support relative to the light-sensitive layers of the photographic element. Particular antistatic layer formulations are disclosed in, e.g., U.S. Pat. Nos. 4,203,769, 4,394,441, 4,418,141, 4,495,278, 5,368,995.

It is also known to include in various kinds of imaging elements a transparent magnetic recording layer containing magnetic particles dispersed in a polymeric binder. The inclusion and use of such transparent magnetic recording layers in light-sensitive silver halide photographic elements has been described in, e.g., U.S. Pat. Nos. 3,782,947; 4,279,945; 4,302,523; 5,217,804; 5,229,259; 5,395,743; 5,413,900; 5,427,900; 5,498,512; and others. Such elements are advantageous because images can be recorded by customary photographic processes while information can be recorded simultaneously into or read from the magnetic recording layer by techniques similar to those employed for traditional magnetic recording art.

The transparent magnetic recording layer must be capable of accurate recording and playback of encoded information repeatedly on demand by various devices such as a camera or a photofinishing or printing apparatus. Said layer also must exhibit excellent running, durability (i.e., abrasion and scratch resistance), and magnetic head-cleaning properties without adversely affecting the imaging quality of the photographic elements. However, this goal is extremely difficult to achieve because of the nature and concentration of the magnetic particles required to provide sufficient signal to write and read magnetically stored data and the effect of any noticeable color, haze or grain associated with the magnetic layer on the optical density and granularity of the photographic layers. These goals are particularly difficult to achieve when magnetically recorded information is stored and read from the photographic image area. Further, because of the curl of the photographic element, primarily due to the photographic layers and the core set of the support, the magnetic layer must be held more tightly against the magnetic heads than in conventional magnetic recording in order to maintain planarity at the head-media interface during recording and playback operations. Thus, all of these various characteristics must be considered both independently and cumulatively in order to arrive at a commercially viable photographic element containing a transparent magnetic recording layer that will not have a detrimental effect on the photographic imaging performance and still withstand repeated and numerous read-write operations by a magnetic head.

Problems associated with the formation and discharge of electrostatic charge during the manufacture and utilization of photographic film and paper have been recognized for many years by the photographic industry as discussed above. In films comprising a transparent magnetic recording layer which are designed to be used in automatic cameras, because of the repeated motion of a photographic roll film in and out of a film cassette, there is the added problem of the generation of electrostatic charge by the movement of the film across magnetic heads and by the repeated winding and unwinding operations, especially in a low relative humidity environment. The accumulation of charge on the film surface results in the attraction and adhesion of dust to the film. The presence of dust not only can result in the introduction of physical defects and the degradation of the image quality of the photographic element but also can result in the introduction of noise and the degradation of magnetic recording performance (e.g., S/N ratio, "drop-outs", etc.). This degradation of magnetic recording performance can arise from various sources including signal loss resulting from increased head-media spacing, electrical noise caused by discharge of the static charge by the magnetic head during playback, uneven film transport across the magnetic heads, clogging of the magnetic head gap, and excessive wear of the magnetic heads. Accordingly, the use of a conductive antistatic layer in photographic elements comprising transparent magnetic recording layers is especially important. Typically, in photographic elements of prior art comprising a transparent magnetic recording layer, the antistatic layer is present as a backing layer underlying the magnetic recording layer (see, e.g., U.S. Pat. No. 5,457,013).

It is also frequently desirable to coat one or more curl control layers on the back-side of the support of a photographic film element comprising light-sensitive layers in order to prevent excessive curl in the element upon drying of the coated light-sensitive layers, to ensure the film element remains sufficiently flat in a camera or printer during exposure and printing to optimize focus conditions, as well as to facilitate transport of the film through a camera and processing apparatus. Such back-side curl control layers typically comprise a hydrophilic binder coated from an aqueous formulation, and are of sufficient total thickness upon drying (generally from 1–25 micrometers) to off-set the curl generated by the hydrophilic binder layers on the light-sensitive emulsion layer side of the support to a desired degree. Use of curl control layers is especially important where a transparent magnetic recording layer is included in relatively wide (i.e., wider than 35 mm) roll camera films, such as 120 and 220 medium format films, and sheet films including as x-ray and graphic arts films, as such films are generally more sensitive to curl and the resulting degradation of magnetic recording performance associated with variable head-media spacing. Optimized ratios of the thicknesses of light sensitive layers, magnetic recording layers, and curl control layers comprising hydrophilic colloids in photographic elements for curl control are described, e.g., in copending, commonly assigned U.S. Ser. No. 08/604,272, now U.S. Pat. No. 5,753,426 the disclosure of which is incorporated by reference herein.

Adhesion of a backing layer arrangement comprising a substantial curl control layer package in addition to a magnetic recording layer coated over a highly filled (i.e., low binder), relatively thin antistatic layer on a film support can be problematic where the antistatic layer is coated directly on a support or over a thin primer layer (such as a vinylidene chloride based copolymer layer) as is commonly practiced in the art. It would be advantageous to be able to provide curl control, magnetic recording, and highly filled antistatic layers in a film element which exhibited good adhesion performance. It would further be desirable to provide such a film element wherein such layers are effectively simultaneously coatable from aqueous coating compositions in a single coating pass.

SUMMARY OF THE INVENTION

In accordance with one embodiment of the invention, a photographic element is disclosed comprising a film support, at least one light-sensitive layer, a highly loaded layer which contains more than 30 volume percent of non-film forming particulate material, and upper and lower aqueous coated adjacent layers which are next to the highly loaded layer, the upper adjacent layer being further from the support and the lower adjacent layer being closer to the support relative to the highly loaded layer, each adjacent layer having a film forming binder content of greater than 70 volume percent, and the lower adjacent layer being at least 1.0 micron thick. Layer thicknesses are determined after equilibrating the element for 2 days at 25° C. and 55 percent relative humidity. Generally, the thickness of a layer containing at least 1.076 $g/m^2$ (100 $mg/ft^2$) of a hydrophilic binder, such as gelatin, will be at least approximately 1.0 micrometer thick after such equilibration.

In accordance with preferred embodiments of the invention, the invention is particularly applicable for use with highly loaded layers wherein the volume percent of non-film forming particulate material is at least 30% and at most about 90%, more preferably at least about 40% and at most about 80%, and most preferably at least about 50% and at most about 70%. The thickness of the highly loaded layer is preferably less than or equal to about 0.5 micron, more preferably less than or equal to about 0.3 micron and most preferably less than or equal to about 0.2 micron. The thickness of the upper adjacent layer is preferably at least about 0.5 micron. In a particularly preferred embodiment, the thickness of each of the two layers adjacent the highly loaded layer is at least 1.0 micron for optimized adhesion performance.

In accordance with a particular embodiment of the invention, an imaging element having excellent adhesion characteristics is obtained in combination with excellent magnetic recording characteristics and photographic transparency where the non-film forming particulate material in the highly loaded layer comprises conductive particles, the layer adjacent to the highly loaded layer which is closer to the support comprises a hydrophilic curl control layer, and the layer adjacent to the highly loaded layer which is further from the support or a layer coated thereover comprises an aqueous coated transparent magnetic recording layer, by virtue of the physical flatness, low granularity, and optical density of the element.

Another aspect of this invention comprises a process for simultaneously applying a plurality of coating compositions comprising a magnetic recording layer coating composition including a dispersion of magnetic particles in an aqueous medium, an antistatic layer aqueous coating composition, and a curl control layer aqueous coating composition, along with other optional conventional gelatin containing aqueous coated layers, onto a support. An additional advantage of the invention is the ability to obtain a plurality of such layers each of substantially uniform thickness on the back side of an element support through simultaneous application of the respective layer coating solutions using conventional coating equipment (bead coating, curtain coating).

Magnetic dispersions in accordance with preferred embodiments of the invention formulated in an aqueous medium containing a hydrophilic colloid such as gelatin are compatible with and can make it feasible to simultaneously coat the magnetic layer, a hydrophilic curl control layer, and other conventional gelatin containing layers on the back side of the support.

The placing of the highly filled antistatic layer between two aqueous coated adjacent layers, which in a preferred embodiment of the invention comprise a magnetic recording layer and a curl control layer or two curl control layers, results in excellent adhesion of the coated layers to the support compared to where the highly filled antistatic layer is closest to the support. The mechanical properties of a photographic element containing such a highly filled layer is substantially strengthened when the highly filled layer is sandwiched between the two other aqueous coated layers.

Due to the rheology requirements of the bottom layer of a multilayer coating pass, it is also generally difficult to coat a highly filled layer as the bottom layer of a coating pass. The method of the invention wherein a highly filled layer is coated between two adjacent aqueous coated layers accordingly also advantageously reduces the number of coating passes needed for incorporating an antistatic layer and a magnetic recording layer on the same side of the support, thus making the manufacturing process more cost effective.

Aqueous coatings of magnetic and associated layers means that the solvent recovery procedures that are presently employed in solvent coatings will not be needed. In addition to capital savings, the risk of fire and explosion is greatly reduced. Aqueous coatings also make it possible to use high speed high capacity coating machines capable of simultaneous multilayer coatings.

By using aqueous formulations containing colloids such as gelatin for the magnetic layer and the curl control layers, the risk of fogging and adverse sensitization are minimized compared to solvent based coating systems which might include photoactive crosslinkers. An additional advantage of aqueous formulations is that antihalation dyes are readily removable from the curl control layer during processing, and the curl control properties are less sensitive to humidity changes.

DETAILED DESCRIPTION OF THE INVENTION

This invention is directed towards photographic elements comprising a highly loaded layer which contains more than 30 volume percent of non-film forming particulate material. In preferred embodiments, the highly loaded layer is an antistatic layer, and the particulate material comprises conductive fine particles, which are dispersed with an aqueous soluble or dispersible polymeric binder. Suitable conductive particles include those previously proposed for use in antistatic layers for various imaging applications, such as crystalline metal oxides, metal antimonates, and ceramic particles which have been used to prepare optically transparent, humidity insensitive, antistatic layers. Many different metal oxides, such as ZnO, $TiO_2$, $ZrO_2$, $SnO_2$, $Al_2O_3$, $In_2O_3$, $SiO_2$, MgO, BaO, $MoO_3$ and $V_2O_5$, are proposed for use as antistatic agents in photographic elements or as conductive agents in electrostatographic elements in such patents as U.S. Pat. Nos. 4,275,103, 4,394,441, 4,416,963, 4,418,141, 4,431,764, 4,495,276, 4,571,361, 4,999,276 and 5,122,445. Electronically-conductive metal antimonates are disclosed in U.S. Pat. No. 5,457,013. Antistatic layers comprising electro-conductive ceramic particles, such as particles of TiN, NbB2, TiC, LaB6 or MoB, dispersed in a binder such as a water-soluble polymer or solvent-soluble resin are described in Japanese Kokai No. 4/55492, published Feb. 24, 1992. Preferred conductive particles include metal oxides such as antimony doped tin oxide, aluminum doped zinc oxide, and niobium doped titanium oxide, and metal antimonates such as the rutile or rutile-related crystallographic structures represented $M^{+2}Sb^{+5}{}_2O_6$ or $M^{+3}Sb^{+5}\ O_4$ where $M^{+2}$=$Zn^{+2}$, $Ni^{+2}$, $Mg^{+2}$, $Fe^{+2}$, $Cu^{+2}$, $Mn^{+2}$, $Co^{+2}$ and $M^{+3}$=$In^{+3}$, $Al^{+3}$, $Sc^{+3}$, $Cr^{+3}$, $Fe^{+3}$, $Ga^{+3}$.

Surface resistivities are preferably in the range from $10^6$–$10^9$ ohms per square for highly loaded antistatic layers containing the conductive particles. In order to obtain such high electrical conductivity, 0.1–10 g/$m^2$ of metal oxide is typically included in the antistatic layer. High coating levels, however, may result in decreased optical transparency for thick antistatic coatings. In order to minimize light scattering (haze) by the antistatic layer due to the high values of refractive index (>2.0) of the preferred metal oxides, the metal oxides are preferably dispersed in the form of ultrafine particles. For use in imaging elements, the average particle size of the electronically-conductive particles is preferably less than about one micrometer, more preferably less than about 0.5 micrometers and most preferably less than 0.1 micrometers. For use in imaging elements where a high degree of transparency is important, it is preferred to use colloidal particles which have an average particle size in the range of 0.01 to 0.05 micrometers.

Several colloidal conductive metal antimonates are commercially available from Nissan Chemical Industries Ltd. in the form of dispersions in water or in organic solvents. (See published Japanese Patent Application No. 6-219743.) Alternatively, U.S. Pat. Nos. 4,169,104 and 4,110,247 teach a method for preparing certain metal antimonates by treating an aqueous solution of potassium antimonate (i.e., $KSb(OH)_6$) with an aqueous solution of an appropriate soluble metal salt (e.g., chloride, nitrate, sulfate, etc.) to form a gelatinous precipitate of the corresponding insoluble hydrate. The isolated hydrated gels are then washed with water to remove the excess potassium ions and salt anions. The washed gels are peptized by treatment with an aqueous solution of organic base (e.g., triethanolamine, tripropanolamine, diethanolamine, monoethanolamine, quaternary ammonium hydroxides, etc.) at temperatures of 25° to 150° C. as taught in U.S. Pat. No. 4,589,997 for the preparation of colloidal antimony pentoxide sols.

In order to be suitable for use in antistatic coatings for critical photographic applications, the conductive particles must have a small average particle size. Small particle size minimizes light scattering which would result in reduced optical transparency of the coating. The relationship between the size of a particle, the ratio of its refractive index to that of the medium in which it is incorporated, the wavelength of the incident light, and the light scattering efficiency of the particle is described by Mie scattering theory (G. Mie, Ann, Physik., 25, 377 (1908). A discussion of this topic as it is relevant to photographic applications has been presented by T. H. James ("The Theory of the Photographic Process", 4th ed., Rochester: EKC, 1977). In the case of electroconductive particles coated in a thin layer using a typical photographic gelatin binder system, it is necessary to use powders with an average particle size less than about 0.2 μm in order to limit the scattering of light at a wavelength of 550 nm to less than 20%. For shorter wavelength light, such as the ultraviolet light used to expose some daylight-insensitive graphic arts films, electroconductive particles with an average size much less than about 0.1 μm are preferred.

In addition to the optical requirements, a very small average particle size is needed to ensure that even in thin coatings there is a multiplicity of interconnected chains or networks of conductive particles which afford multiple electrically-conductive pathways through the layer and result in electrical continuity. The very small average particle size of conductive colloidal metal antimonte particles (typically 0.01–0.05 μm) results in multiple conductive pathways in thin antistatic layers of preferred embodiments of the present invention. In the case of other commercially available conductive metal oxide pigments, the average particle size (typically 0.5–0.9 μm) can be reduced by various mechanical milling processes well known in the art of pigment dispersion and paint making. However, many of these metal oxide pigments may not be sufficiently chemically homogeneous to permit size reduction by attrition to the colloidal size required to ensure both optical transparency and multiple conductive pathways in thin coatings and still retain sufficient inter-particle conductivity to be useful in an antistatic layer.

Binders useful in the highly loaded thin layers of the invention, such as antistatic layers containing conductive particles such as metal antimonate particles, include: water-soluble polymers such as gelatin, gelatin derivatives, maleic acid anhydride copolymers; cellulose compounds such as carboxymethyl cellulose, hydroxyethyl cellulose, cellulose acetate butyrate, diacetyl cellulose or triacetyl cellulose; synthetic hydrophilic polymers such as polyvinyl alcohol, poly-N-vinylpyrrolidone, acrylic acid copolymers, polyacrylamides, their derivatives and partially hydrolyzed products, vinyl polymers and copolymers such as polyvinyl acetate and polyacrylate acid esters; derivatives of the above polymers; and other synthetic resins. Other suitable binders include aqueous emulsions of addition-type polymers and interpolymers prepared from ethylenically unsaturated monomers such as acrylates including acrylic acid, methacrylates including methacrylic acid, acrylamides and methacrylamides, itaconic acid and its half-esters and diesters, styrenes including substituted styrenes, acrylonitrile and methacrylonitrile, vinyl acetates, vinyl ethers, vinyl and vinylidene halides, olefins, and aqueous dispersions of polyurethanes or polyesterionomers. Solvents useful for preparing coatings of conductive particles include: water, alcohols such as methanol, ethanol, propanol, isopropanol; ketones such as acetone, methylethyl ketone, and methylisobutyl ketone; esters such as methyl acetate, and ethyl acetate; glycol ethers such as 2-methoxyethanol, 2-ethoxyethanol, 1-methoxy-2-propanol; and mixtures thereof. In preferred embodiments of the invention, an aqueous soluble or dispersible binder is used and the highly loaded layer is coated from an aqueous based coating composition.

In addition to binders and solvents, other components that are well known in the photographic art may also be present in the electrically-conductive layer. These additional components include surfactants (including fluorinated surfactants), dispersing aids, coating aids, thickeners, crosslinking agents or hardeners, soluble and/or solid particle dyes, antifoggants, matte particles, lubricants, and others. For example, anionic polymeric thickeners may be added to an antistatic coating solution containing gelatin as a binder to control the viscosity of such layer in relationship to the viscosity of adjacent coated layers in accordance with well-known coating practices.

The ratio of the amount of the non-film forming particles to the film forming binder binder in the highly filled antistatic layer in accordance with preferred embodiments of the invention is one of the important factors which influence the ultimate conductivity achieved by the coated layer. If this ratio is too small, little or no antistatic property is exhibited. If this ratio is very large, adhesion between the conductive layer and the support can be diminished. The optimum ratio of conductive particles to binder varies depending on the particle size, binder type, and conductivity requirements. The preferred volume fraction of conductive particles, however, is generally in the range of from about 30 to 90%, more preferably 40% to 80%, and most preferably 50% to 70% of the volume of the coated layer. The thickness of the resulting coated layer after drying and equilibration in accordance with the invention is preferably less than 0.5 micron, more preferably less than or equal to about 0.3 micron, and most preferably less than or equal to about 0.2 micron. The concentration of conductive particles present in the coated layer will vary depending on the weight density of the particular compound used.

In order to provide such relatively thin, highly loaded layers in accordance with the invention having good adhesion to a support and layers coated thereover, the highly filled layer is coated over a relatively thicker adjacent layer which has a thickness of at least 1.0 microns and which is less highly filled with particulate material, and more preferably coated between two adjacent layers, each of which is relatively thicker and less highly filled with particulate material than the highly filled layer. The thickness of the upper adjacent layer is preferably at least about 0.5 micron. In a preferred embodiment, the thickness of each of the two layers adjacent the highly loaded layer is at least 1.0 micron for optimized adhesion performance. In a particular embodiment of the invention, the adjacent layers comprise a transparent magnetic recording layer and a curl control layer or two curl control layers, each of which is coated from aqueous based coating compositions.

This invention in preferred embodiments relates to photographic elements comprising transparent layers containing magnetic particles, the layers being capable of having coded information written and read therefrom. The transparent layers containing magnetic particles are particularly applicable for use in combination with photographic elements wherein information can be written into the magnetic layer without affecting the quality and performance of the light-sensitive photographic elements.

The transparent magnetic recording layer of preferred embodiments of this invention comprises a dispersion of magnetic particles, a dispersant preferably whose HLB number is greater than 8 and is selected from amphipathic water dispersible or soluble compounds, a film forming binder such as gelatin or other hydrophilic colloid and optionally a viscosifier of synthetic or naturally occurring materials as described in U.S. Pat. Nos. 5,457,012, 5,531,913 and 5,520,954, incorporated herein by reference.

It is a feature of preferred embodiments of this invention that the photographic element comprises a support and at least one light sensitive layer having a hydrophilic binder on the first side of the support and on the opposite side of the support at least one hydrophilic colloid curl control layer, a highly loaded particulate containing antistatic layer, and a transparent magnetic recording layer comprising ferromagnetic particles in a hydrophilic colloid and optionally, a lubricating layer over the magnetic recording layer, where the thickness of these layers is in accordance with the relationships set forth above.

The structure of the photographic element in accordance with this invention is especially suitable for color reversal, color negative, and black and white medium format films, as well as x-ray (radiographic) and graphic arts films, which require strict anticurl characteristics to assure film plane flatness both before and after photographic processing which is required for optimum performance.

The magnetic layer may comprise, for example, fine ferromagnetic powders such as ferromagnetic gamma-iron oxides, cobalt surface-treated ferromagnetic iron oxides, cobalt-doped ferromagnetic iron oxides, cobalt containing $Fe_2O_3$, ferromagnetic magnetites, cobalt-containing ferromagnetic magnetites, ferromagnetic chromium dioxides, ferromagnetic metal powders, ferromagnetic iron powders, ferromagnetic alloy powders and the class of ferromagnetic ferrite powders including barium ferrites. Additionally, the above mentioned powder particles may be modified to provide lower light extinction and scattering coefficients by providing them with a shell, of at least the same volume as the magnetic core, of a low refractive index material that has its refractive index lower than the transparent polymeric material used to form the magnetizable layer. Typical shell materials may include amorphous silica, vitreous silica, glass, calcium fluoride, magnesium fluoride, lithium fluoride, polytetrafluoroethylene and fluorinated resins. Examples of the ferromagnetic alloy powders include those comprising at least 75% by weight of metals which comprise at least 80% by weight of at least one ferromagnetic metal alloy (such as Fe, Co, Ni, Fe—Co, Fe—Ni, Co—Ni, Co—Ni—Fe) and 20% or less of other components (such as Al, Si, S, Sc, Ti, V, Cr, Mn, Cu, Zn, Y, Mo, Rh, Re, Pd, Ag, Sn, B, Ba, Ta, W, Au, Hg, Pb, La, Ce, Pr, Nd, Te, and Bi). The ferromagnetic metals may contain a small amount of water, a hydroxide or an oxide. In addition, magnetic oxides with a thicker layer of lower refractive index oxide or other material having a lower optical scattering cross section as taught in U.S. Pat. No. 5,252,444 may also be used.

The magnetic particles in accordance with preferred embodiments of this invention preferably are acicular or needle like magnetic particles. The average length of these particles along the major axis preferably is less than about 0.3, more preferably, less than about 0.2 micrometer. The particles preferably exhibit an axial ratio, that is, a length to diameter thickness ratio of up to about 5 or 6 to 1. Preferred particles have a specific surface area of at least 30 $m^2/g$, more preferably of at least 40 $m^2/g$. Typical acicular particles of this type include for example, particles of ferri and ferro iron oxides such as gamma-ferric oxide, complex oxides of iron and cobalt, various ferrites and metallic iron pigments. Alternatively, small tabular particles such as barium ferrites and the like can be employed. The particles can be doped with one or more ions of a polyvalent metal such as titanium, tin, cobalt, nickel, zinc, manganese, chromium, or the like as is known in the art.

A preferred particle consists of Co surface treated g-$Fe_2O_3$ having a specific surface area of greater than 40 $m^2/g$. Particles of this type are commercially available and can be obtained from Toda Kogyo Corporation under the trade names CSF 4085V2, CSF 4565V, CSF 4585V and CND 865V and are available on a production scale from Pfizer Pigments Inc. under the trade designations RPX-4392, RPX-5003, RPX-5026 and RPX-5012. For good magnetic recording, the magnetic particles preferably exhibit coercive force above about 500 Oe and saturation magnetization above 70 emu/g.

In accordance with preferred embodiments of this invention, the transparent magnetic layer is prepared by initially forming a concentrated dispersion of the magnetic particles in water together with a dispersant as described in the above-mentioned U.S. Patents, preferably one having an HLB number of at least 8, more preferably an amphipathic water-dispersible or soluble polymeric dispersant, and milling the resulting mixture in a device such as a ball mill, a roll mill, a high speed impeller mill, media mill, an attritor, a sand mill or the like as described in U.S. Pat. No. 5,457,012. Milling is continued for a sufficient time to ensure that substantially no agglomerates of the magnetic particles remain.

The concentration of the magnetic particles in the dispersion is preferably about 5 to about 75%, more preferably about 10 to about 50% and most preferably about 15 to about 35%, the percentages being by weight based on the weight of the dispersion.

The length of time required depends on the particular milling device used. In general, milling should be continued from about 0.5 to about 8 hours, preferably from about 1 to about 4 hours.

The transparent magnetic recording layer is preferably coated over at least one curl control layer on the side opposite the light-sensitive layers of the photographic film. This provides ease of encoding and readout while controlling the curl at the same time. Information can then be encoded into the magnetic layer during all steps of the preparation of the photographic product. This can include manufacturing data with regard to the various layers that are employed during the preparation of the film, information with regard to the properties of the various layers built onto the substrate and the like. Further, after the film is completed and is being used by the consumer, many and various applications can be envisioned wherein information is included in the magnetic layer that is helpful to the photographer, the developing laboratory and others engaged in this field of endeavor. For example, when a camera also has the capability of imparting data to a magnetic layer by having built in recording heads in the camera, information with regard to each frame of the film can be recorded, such as, the light conditions, the speed at which the frame is exposed, the F-Stop number and the like.

To apply a transparent magnetic recording layer, a highly loaded antistatic layer, and curl control layers simultaneously to a support, coating compositions are prepared, for example by dispersing the appropriate materials in aqueous media containing hydrophilic binders. Examples of hydrophilic binders which can be used are those described in *Research Disclosure* No. 308119, December 1989, and No. 18716 (page 651) November 1979. Illustrative hydrophilic binders include water-soluble polymers, gelatin, gelatin derivatives, cellulose esters, latex derivatives, casein, agar, sodium alginate, starch, polyvinyl alcohol, polyacrylic acid copolymers and maleic anhydride copolymers and mixtures thereof. The cellulose esters include hydroxyl propyl cellulose, carboxymethyl cellulose and hydroxyethyl cellulose. The latex polymers include vinyl chloride copolymers, vinylidene chloride copolymers, acrylic ester copolymers, vinyl acetate copolymers and butadiene copolymers. Among them, gelatin is most preferred.

Gelatin may be any of so-called alkali-treated (lime treated) gelatin which was immersed in an alkali bath, prior to extraction thereof, an acid-treated gelatin which was immersed in an alkali bath prior to extraction thereof, an acid-treated gelatin which was immersed in both baths and enzyme-treated gelatin. If necessary, gelatin can be used in combination with colloidal albumin, casein, a cellulose derivative (such as carboxymethyl or hydroxyethyl cellulose), agar, sodium alginatc, a saccharide derivative (such as a starch derivative or dextrin), a synthetic hydrophilic colloid (such as polyvinyl alcohol, poly-N-vinylpyrolidone, a polyacrylic acid copolymer, polyacrylamide or a derivative or partial hydrolyzate thereof) or a gelatin derivative. The use of a polyelectrolyte viscosifier as disclosed in U.S. Pat. No. 5,531,913 may be especially desired in the magnetic recording layer to minimize haze upon layer drying if required.

The curl control layer package, coated opposite the light sensitive emulsion layer, may contain any of the above-mentioned hydrophilic colloids and may also contain absorber dyes to prevent halation effects of light being passed through the front emulsion layer and support and being back scattered and/or reflected back to the emulsion layer. Such effects result in loss of image sharpness. A single curl control layer or multiple layers may be coated. The total thickness of the curl control layers is generally anywhere from 1–25 micrometers thick. For use with relatively wide roll camera films, such as 120 and 220 medium format films, and sheet films including as x-ray and graphic arts films in accordance with preferred embodiments of the invention, the total thickness of the hydrophilic binder containing layers on the side of the support opposite to the light-sensitive layer is preferably from about 2 to 25 micrometers, more preferably from about 5 to 25 micrometers, and most preferably from about 8 to 25 micrometers.

A coating composition containing dispersed magnetic particles, dispersant, film-forming hydrophilic binder and optionally a polyelectrolyte may be coated simultaneously along with a highly loaded antistatic layer coating solution and curl control coating solutions onto a suitable support such that the highly loaded layer is sandwiched between two aqueous coated layers, such as the magnetic layer coating composition and a curl control layer coating composition or between two curl control layer coating compositions. The magnetic layer is preferably on top of the antistatic and curl control layers, either as is or along with additional or optional ingredients such as, crosslinking or hardening agents, coating aids, abrasive particles, lubricants, matting agents, antistatic agents, fillers and the like. Optionally, a lubricating layer may be simultaneously coated over the magnetic layer.

The magnetic coating composition, antistatic layer composition, and the curl control compositions may be applied simultaneously to a support which may contain additional layers such as conventional subbing layers for promoting adhesion and the like by any suitable coating device including slot die hoppers, slide hoppers, and the like. The thickness of the magnetic layer preferably should be about 0.5 to about 10 microns, more preferably at least about 0.75 and at most about 5 microns, and most preferably at least about 1.0 and at most about 3 microns.

The magnetic layer can also be overcoated with conventional layers including protective overcoats, antistats, lubricants and the like either in a separate coating step or simultaneously as indicated above. Any suitable support may be employed in the practice of this invention, such as, cellulose derivatives including cellulose diacetate, cellulose triacetate, cellulose propionate, cellulose butyrate, cellulose acetatepropionate and the like; polyamides; polycarbonates; polyesters, particularly polyethylene terephthalate, poly-1, 4-cyclohexanedimethylene terephthalate, polyethylene 1, 2-diphenoxyethane-4,4'-dicarboxylate, polybutylene terephthalate and polyethylene naphthalate; polystyrene, polypropylene, polyethylene, polymethyl-pentene, polysulfone, polyethersulfone, polyarylates, polyether imides and the like. Supports for photographic elements are described in *Research Disclosure*, December 1989, Item 308,119 published by Kenneth Mason Publications, Ltd., Dudley Annex, 12a North Street, Emsworth, Hampshire P010 7DQ, England, Section XVII, incorporated herein by reference. Particularly preferred supports are polyethylene terephthalate, polyethylene naphthalate and the cellulose esters particularly cellulose triacetate. Thickness of the supports used in the present invention is preferably from 50 microns to 300 microns, more preferably from 75 to 200 microns. In addition, various dyes may be formulated into the support or the magnetic layer to give neutral or the desired density.

Depending upon the nature of the support, suitable transparent tie or undercoat layers may be desired. Polyester supports, e.g., typically employ an undercoat or primer layer between the support and the layers coated thereon above it in order to promote adhesion. Such undercoat layers are well known in the art and comprise, for example, a vinylidene chloride/methyl acrylate/itaconic acid terpolymer or a vinylidene chloride/acrylonitrile/acrylic acid terpolymer as described in U.S. Pat. Nos. 2,627,088; 2,698,235; 2,698,240; 2,943,937; 3,143,421; 3,201,249; 3,271,178; and 3,501,301. To promote adhesion of thick curl control or light sensitive gelatin based layers coated over it, another thin subbing layer comprising about 0.05 to 0.3 g/m$^2$ gelatin is usually coated over the above described undercoat layer.

The magnetic recording layer of preferred embodiments of the present invention containing gelatin or other hydrophilic colloid, the curl control layer, and any other layers on the same side containing gelatin, for example, is preferably hardened. The entire plurality of layers on the back side of the support may be hardened at once by introducing the hardener to layer closest to the support and allowing it to diffuse to the upper layers. Hardeners usable for hardening these layers include, for example, aldehyde compounds such as formaldehyde and glutaraldehyde; ketone compounds such as diacetyl and cyclopentanedione; compounds having reactive halogens such as bis(2-chloroethylurea), 2-hydroxy-4,6-dichloro-1,3,5-trizine and those described in U.S. Pat. Nos. 3,288,775 and 2,732,303 and British Patent Nos. 974,723 and 1,167,207; divinylsulfone, 5-acetyl-1,3-diacrylolhexahydro-1,3,5-triazine and reactive olefin-containing compounds such as divinylsulfone, 5-acetyl-1,2-diacryloyl-hexahydro-1,3,5-triazine, and the compounds such as divinylsulfone, 5-acetyl-1,3-diacryloyl-hexahydro-1,3,5-triazine, and the compounds disclosed in U.S. Pat. Nos. 3,635,718 and 3,232,763, and British Patent 994,869; N-hydroxymethylothalimide; N-methylol compounds such as N-hydroxymethylphthalimide and those described in U.S. Pat. Nos. 2,732,316 and 2,586,168; isocyanates described in U.S. Pat. Nos. 3,103,437; the aziridines disclosed in U.S. Pat. Nos. 3,017,280 and 2,983,611; acid derivatives described in U.S. Pat. Nos. 2,725,294 and 2,725,295; epoxy compounds described in U.S. Pat. No. 3,091,537; and halogenated carboxyaldehydes such as mucochloric acid. Examples of inorganic hardeners include chrome alum, zirconium sulfate and the carboxyl group activating hardeners described in Japanese Patent Publication for opposition purpose (herein after referred to as J.P. Kokoku) Nos. 56-12853 and 58-32699, Belgian Patent No. 825,726, J.P. Kokai Nos. 60-225148 and 51-126125, J.P. Kokoku No. 58-50699, J.P. Kokai No. 52-54427 and U.S. Pat. No. 3,321,313. Hardeners are generally used in an amount of from 0.01 to 30 weight percent, preferably from 0.05 to 20 weight percent, to the amount of dried gelatin.

Additional ingredients can optionally be included in the coating compositions of the various layers of the element of this invention. In certain embodiments of the invention, e.g., the magnetic layer coating composition (and thus, the magnetic layer) may contain abrasive particles, reinforcing fillers or tin oxide. Examples of abrasive and/or reinforcing filler particles include nonmagnetic inorganic powders with a Mohs scale hardness of not less than 6. Specific examples are metal oxides such as ($\alpha$-alumina, y-alumina, chromium oxide (e.g., $Cr_2O_3$), iron oxide alpha (e.g., $Fe_2O_3$), silicon dioxide, alumino-silicate and titanium carbide; carbides such as silicon carbide and titanium carbide; nitrides such as, silicon nitride, titanium nitride and diamond in fine powder. Alpha alumina and silicon dioxide are the preferred abrasives in accordance with this invention. These can be pre-dispersed in water using the same dispersants as described in this invention and then incorporated into the coating composition. Tin oxide particles in any form may be employed such as tin oxide per se or doped tin oxides, such as, antimony or indium doped tin oxide. The tin oxide may be used in either the conductive or non-conductive form; however, when in the conductive form, an additional advantage is gained in that the layer also acts as an antistat. Suitable conductive particles are disclosed in U.S. Pat. Nos. 4,495,276; 4,394,441; 4,431,764; 4,418,141 and 4,999,276 incorporated herein by reference. Useful tin oxide particles are commercially available from Keeling and Walker, Ltd. under the trade designation Stanostat CPM 375; DuPont Co. under the trade designation Zelec-ECP 3005XC and 3010SC and Mitsubishi Metals Corp. under the trade designation T-1. Preferred metal antimonates include those having rutile or rutile-related crystallographic structures as those disclosed in U.S. Pat. No. 5,368,995, the disclosure of which is incorporated by reference herein. These can be also be predispersed in water using the same dispersants as described for the magnetic recording layer particle dispersion and then incorporated into the coating composition.

As noted, photographic elements in accordance with this invention comprise at least one photosensitive layer. Such photosensitive layers can be image-forming layers containing photographic silver halides such as silver chloride, silver bromide, silver bromoiodide, silver chlorobromide and the like. Color reversal, color negative, and black and white medium format films, as well as x-ray (radiographic) and graphic arts films are specifically contemplated. Any of the known silver halide emulsion layers, such as those described in *Research Disclosure*, Vol. 176, December 1978 Item 17643 and *Research Disclosure* Vol. 225, January 1983 Item 22534, the disclosures of which are incorporated by reference in their entirety, are useful in preparing photographic elements in accordance with this invention. Generally, the photographic element is prepared by coating the support film on the side opposite the magnetic recording, antistatic, and curl control layers with one or more layers comprising a dispersion of silver halide crystals in an aqueous solution of gelatin and optionally one or more subbing layers, such as, for example, gelatin, etc. The coating process can be carried out on a continuously operating machine wherein a single layer or a plurality of layers are applied to the support. The layers can be coated simultaneously on the composite support film as described in U.S. Pat. No. 2,761,791 and U.S. Pat. No. 3,508,947. Additional useful coating and drying procedures are described in *Research Disclosure*, Vol. 176, December 1978, Item 17643. Suitable photosensitive image forming layers are those which provide color or black and white images.

As is taught in U.S. Pat. No. 3,782,947, whether an element is useful for both photographic and magnetic recording depends on both the size distribution and concentration of the magnetic particles and on the relationship between the granularities of the magnetic and photographic coatings. Generally, of course, the coarser the grain of the emulsion in the photographic element that contains the magnetic recording layer, the larger the mean size of the magnetic particles which can be tolerated. A magnetic particle concentration between about 10 and 1000 mg/m$^2$ when uniformly distributed across the desired area of the photographic element will be sufficiently photographically transparent provided that the maximum particle size is less than about 1 micrometer. Particle concentrations less than about 10 mg/m$^2$ tend to be insufficient for magnetic recording purposes and particle concentrations greater than about 1000 mg/m$^2$ tend to be too dense for photographic purposes. Particularly useful particle concentrations are in the range of 20–70 mg/m$^2$. Concentrations of about 20 mg/m$^2$ have been found to be particularly useful in reversal films and concentrations of about 40 mg/m$^2$ are particularly useful in negative films.

The photographic elements according to this invention can be provided with a protective or lubricating layer, such as a wax layer, in or over the transparent magnetic recording layer. Suitable lubricants include silicone oil, silicones having polar groups, fatty acid-modified silicones, fluorine-containing silicones, fluorine-containing alcohols, fluorine-containing esters and polyolefins, polyolefins, polyglycols alkyl phosphates and alkali metal salts thereof, alkyl sulfates and alkali metal salts thereof, polyphenyl ethers, fluorine-containing alkyl sulfates and alkali metal salts thereof, monobasic fatty acids having 10 to 40 carbon atoms (which may contain unsaturated bonds or may be branched) and metal salts thereof (such as Li, Na, K and Cu), monovalent, divalent, trivalent, tetravalent, pentavalent and hexavalent alcohols having 12 to 40 carbon atoms (which may contain unsaturated bonds or may be branched), alkoxy alcohols having 12 to 40 carbon atoms, mono-, di- and tri-esters of monobasic fatty acids having 10 to 40 carbon atoms (which may contain unsaturated bonds or may be branched) and one of monovalent, divalent, trivalent, tetravalent, pentavalent and hexavalent alcohols having 2 to 12 carbon atoms (which may contain unsaturated bonds or may be branched), fatty acid esters of monoalkyl ethers of alkylene oxide polymers, fatty acid amides having 8 to 40 carbon atoms and aliphatic amines having 8 to 40 carbon atoms. Specific examples of these compounds (i.e., alcohols, acids or esters) include camauba wax, lauric acid, myristic acid, palmitic acid, stearic acid, behenic acid, butyl stearate, oleic acid, linoleic acid, linolenic acid, elaidic acid, octyl stearate, amyl stearate, isooctyl stearate, octyl myristate, butoxyethyl stearate, anhydrosorbitan monostearate, anhydrosorbitan distearate, anhydrosorbitan tristearate, pentaerythrityl tetrastearate, oleyl alcohol and lauryl alcohol. Preferably, the lubricating layer is applied simultaneously with the magnetic layer, antistatic layer, and the curl control layer where the composition of the lubricating layer includes gelatin, a viscosifier, a lubricant, and water.

The invention is further illustrated in accordance with the following examples.

EXAMPLE 1 (comparison)

An antistat coating formulation comprising 0.377 g/m$^2$ colloidal conductive zinc antimonate particles (Nissan Chemical Industries Ltd.) with average particle size of about 0.01 to 0.05 microns, 0.067 g/m$^2$ gelatin, and 0.0013 g/m$^2$ dihydroxydioxane hardner was coated on a 4 mil thick polyethylene terephthalate film support subbed with a terpolymer of acrylonitrile, vinylidene chloride and acrylic acid. The electrically-conductive antistatic layer was then overcoated with a multilayer pack comprising three curl control hydrophilic colloid layers and a transparent magnetic recording layer in a simultaneous coating operation to obtain the coated structure illustrated below. The aqueous magnetic coating composition was prepared according to U.S. Pat. Nos. 5,457,012 and 5,531,913.

Magnetic Recording Layer

Gelatin 1.025 g/m$^2$
γ-Iron Oxide 0.0592 g/m$^2$
α-Alumina 0.0592 g/m$^2$
Syn Fac 8337 polymeric dispersant 0.0296 g/m$^2$
Carnauba Wax 0.204 g/m$^2$
Hardener 0.159 g/m$^2$
Curl Control Layer 3 (CCL3)

Gelatin 2.493 g/m$^2$
Curl Control Layer 2 (CCL2)

Gelatin 3.07 g/m$^2$
Curl Control Layer 1 (CCL1)

Gelatin 3.65 g/m$^2$
Antistatic Layer

Zinc Antimonate colloidal particles 0.377 g/m$^2$
Gelatin 0.067 g/m$^2$
Dihydroxydioxane hardener 0.0013 g/m$^2$
4 mil Polyethylene terephthalate film Subbed Support

EXAMPLES 2–4 (invention)

A 4-mil thick polyethylene terephthalate support was subbed with the terpolymer described in Example 1, and a gelatin primer layer over it. The subbed support was then overcoated with three curl control layers and a magnetic recording layer as in Example 1, along with an antistatic layer positioned either between the magnetic recording layer and curl control layer CCL3 (Example 2), between curl control layers CCL3 and CCL2 (Example 3), or between curl control layers CCL2 and CCL1 (Example 4). The position of the antistatic layer is indicated in Table 1. The antistatic layer comprised 0.0732 g/m$^2$ gelatin, 0.538 g/m$^2$ zinc antimonate conductive particles, and 0.0022 g/m$^2$ polystyrene sulfonate. In each of Examples 2–4, the curl control, magnetic recording, and antistatic layers were coated in a simultaneous coating operation;

The wet adhesion of the coatings to the support after drying of the coatings was evaluated for Examples 1–4 by making a score in the coatings using a razor blade, following by rubbing of the coating over the scored area in 50° C. water, and visual examination for removal of coated layers from the support. Adhesion failure is indicated where coated layers are removed from greater than 10% of the test surface area rating. Results are indicated in Table 1 below.

TABLE 1

| Example | Position of Antistat Layer | Adhesion Failure (wet) at 50° C. |
|---|---|---|
| 1 (comparison) | Directly over support | Yes |
| 2 (invention) | Between magnetic layer and CCL3 | No |
| 3 (invention) | Between CCL3 and CCL2 | No |
| 4 (invention) | Between CCL2 and CCL1 | No |

As can be seen from the results indicated in Table 1, observable failure which results when a highly filled layer such as an antistatic layer is coated directly over a subbed support and under relatively thicker curl control and magnetic recording layers as in comparison Example 1 is eliminated when the highly filled layer is positioned above a relatively thick, less filled layer in accordance with the invention Examples 2–4.

This invention has been described in detail with particular reference to preferred embodiments thereof. It will be understood that variations and modifications can be made within the spirit and scope of the invention.

What is claimed is:

1. A photographic element comprising a film support, at least one light-sensitive layer, a highly loaded layer which contains more than 30 volume percent of non-film forming particulate material, and upper and lower aqueous coated adjacent layers which are next to the highly loaded layer, the upper adjacent layer being further from the support and the lower adjacent layer being closer to the support relative to the highly loaded layer, each adjacent layer having a film forming binder content of greater than 70 volume percent, the lower adjacent layer being at least 1.0 micron thick, and the upper adjacent layer or a layer coated thereover comprises a transparent magnetic recording layer.

2. The element according to claim 1, wherein the volume percent of non-film forming particulate material in the highly loaded layer is from 30–90%.

3. The element according to claim 1, wherein the volume percent of non-film forming particulate material in the highly loaded layer is from 50–70%.

4. The element according to claim 1, wherein the thickness of the highly loaded layer is less than 0.5 micron.

5. The element according to claim 1, wherein the thickness of the highly loaded layer is less than or equal to 0.3 micron.

6. The element according to claim 1, wherein the thickness of the highly loaded layer is less than or equal to 0.2 micron.

7. The element according to claim 1, wherein the thickness of the upper adjacent layer is at least 0.5 micron.

8. The element according to claim 1, wherein the thickness of each of the two adjacent layers is at least 1.0 micron.

9. The element according to claim 1, wherein the non-film forming particulate material in the highly loaded layer comprises conductive particles.

10. The element according to claim 1, wherein the non-film forming particulate material in the highly loaded layer comprises metal oxide particles.

11. The element according to claim 10, wherein the metal oxide particles comprise zinc antimonates.

12. The element according to claim 10, wherein the metal oxide particles comprise tin oxide.

13. The element according to claim 1, wherein the highly loaded layer and the two layers adjacent thereto are coated on the side of the support opposite to the light-sensitive layer.

14. The element according to claim 1, wherein the binder of the adjacent layers comprises a hydrophilic colloid.

15. The element according to claim 1, wherein the binder of the adjacent layers comprises gelatin.

16. The element according to claim 1, wherein the light-sensitive layer comprises a hydrophilic binder, the two layers adjacent the highly loaded layer comprise hydrophilic binders, the highly loaded layer and the two layers adjacent thereto are coated on the side of the support opposite to the light-sensitive layer, and the total thickness of the hydrophilic binder containing layers on the side of the support opposite to the light-sensitive layer is from about 2 to 25 microns.

17. The element according to claim 16, wherein the total thickness of the hydrophilic binder containing layers on the side of the support opposite to the light-sensitive layer is from about 5 to 25 microns.

18. The element according to claim 16, wherein the total thickness of the hydrophilic binder containing layers on the side of the support opposite to the light-sensitive layer is from about 8 to 25 microns.

19. The element of claim 18 being a color reversal, color negative, or black and white medium format film.

20. The element of claim 16 being a color reversal, color negative, or black and white medium format film.

21. The element according to claim 1, wherein the upper adjacent layer comprises a transparent magnetic recording layer.

22. The element according to claim 1, wherein the lower adjacent layer comprises a hydrophilic curl control layer.

23. A photographic element comprising a film support, at least one light-sensitive layer, a highly loaded layer which contains more than 30 volume percent of non-film forming particulate material, and upper and lower aqueous coated adjacent layers which are next to the highly loaded layer, the upper adjacent layer being further from the support and the lower adjacent layer being closer to the support relative to the highly loaded layer, each adjacent layer having a film forming binder content of greater than 70 volume percent, and the lower adjacent layer being at least 1.0 micron thick, wherein the thickness of the highly loaded layer is less than or equal to 0.3 micron, the light-sensitive layer comprises a hydrophilic binder, the two layers adjacent the highly loaded layer comprise hydrophilic binders, the highly loaded layer and the two layers adjacent thereto are coated on the side of the support opposite to the light-sensitive layer, and the total thickness of the hydrophilic binder containing layers on the side of the support opposite to the light-sensitive layer is from about 2 to 25 microns.

24. The element according to claim 23, wherein the total thickness of the hydrophilic binder containing layers on the side of the support opposite to the light-sensitive layer is from about 5 to 25 microns.

25. The element according to claim 23, wherein the total thickness of the hydrophilic binder containing layers on the side of the support opposite to the light-sensitive layer is from about 8 to 25 microns.

26. The element of claim 23 comprising a color reversal, color negative, or black and white medium format film.

27. The element according to claim 23, wherein the lower adjacent layer comprises a hydrophilic curl control layer.

28. A method of making a photographic element having at least one light-sensitive layer on one side of a support and backing layers on the opposite side of the support which comprises:

a) providing a photographic film support having a first and a second side, b) simultaneously applying to the first side of the support, in order: (i) an aqueous solution of a hydrophilic colloid to form at least one curl control layer, (ii) an aqueous dispersion of conductive particles to form an antistatic layer, and (iii) an aqueous magnetic dispersion of magnetic particles in a hydrophilic colloid to form a magnetic recording layer, wherein the antistatic layer comprises a highly loaded layer which contains more than 30 volume percent of non-film forming particulate material and the thickness of the curl control layer is greater than 1 micron, and c) applying to the second side of the support at least one light-sensitive layer.

29. The method of claim 28, wherein the total thickness of the hydrophilic colloid containing layers on the first side of the support is from about 2 to 25 micrometers.

30. The method of claim 28, wherein the total thickness of the hydrophilic colloid containing layers on the first side of the support is from about 8 to 25 micrometers.

31. The method of claim 28, wherein at least one additional curl control layer is coated between the antistatic layer and the magnetic recording layer.

* * * * *